US005155712A

United States Patent [19]

Mose et al.

[11] Patent Number: 5,155,712

[45] Date of Patent: Oct. 13, 1992

[54] WHEEL AND PINION ASSEMBLY WITH FRICTION DRIVE/SLIP COUPLING FOR A TIMEPIECE

[75] Inventors: Friedrich Mose, Pforzheim/Wurm, Fed. Rep. of Germany; Michel Plancon, Besancon, France; Herbert Schwartz, Wurmberg, Fed. Rep. of Germany

[73] Assignee: Timex Corporation, Waterbury, Conn.

[21] Appl. No.: 870,864

[22] Filed: Apr. 20, 1992

[51] Int. Cl.[5] ..... G04B 27/02; G04B 19/02

[52] U.S. Cl. ..... 368/190; 368/220; 368/322

[58] Field of Search ..... 368/185, 190-199, 368/220, 322, 323

[56] References Cited

U.S. PATENT DOCUMENTS

| | | | |
|---|---|---|---|
| 3,290,875 | 12/1966 | Egger et al. | 58/125 |
| 3,779,002 | 12/1973 | Zaugg | 58/59 |
| 3,837,161 | 9/1974 | Wuthrich | 58/42.5 |
| 4,209,969 | 7/1980 | Kitai et al. | 368/250 |
| 4,233,680 | 11/1980 | Sudler et al. | 368/76 |
| 4,259,735 | 3/1981 | Vuille | 368/34 |
| 4,415,272 | 11/1983 | Heinzelmann | 368/69 |
| 4,932,011 | 6/1990 | Schwartz | 368/185 |

FOREIGN PATENT DOCUMENTS 5739 10/1892 Switzerland .

*Primary Examiner*—Vit W. Miska

*Attorney, Agent, or Firm*—William C. Crutcher

[57] ABSTRACT

An improved reduction gear assembly with friction drive/slip coupling for a timepiece movement, comprising a metal pinion member having a toothed pinion and a coaxial stem extending from an abutment surface on said pinion, including (1) a cylindrical portion, (2) a frustum portion tapering from a smaller diameter to a larger diameter (3) a terminating tapered end portion; and a plastic wheel member having a toothed wheel and first and second coaxial journals extending from opposite sides of the. A central passage in the journals has a constricted section therein with a diameter slightly less than that of said larger diameter of said frustum portion on said metal pinion member with the frustum disposed in said constricted passage with a snap fit, whereby a friction drive/slip coupling is provided between the metal frustum portion of the metal pinion member and the constricted passage of the plastic wheel member.

4 Claims, 2 Drawing Sheets

WHEEL AND PINION ASSEMBLY WITH FRICTION DRIVE/SLIP COUPLING FOR A TIMEPIECE

BACKGROUND OF THE INVENTION

This invention relates generally to a reduction gear assembly for an electronic timepiece in which the minute and hour hands may be manually set without rotating the seconds hand. More particularly, the invention relates to an improved friction drive/slip coupling in a wheel and pinion reduction gear assembly for use in a timepiece.

Timepieces for many years have employed gear trains incorporating a friction drive/slip coupling at some point in the gear train. The purpose of such a friction drive/slip coupling is to allow one section of the gear train to be rotated, during setting the hour and minute hands of timepiece, while the other section of the gear train remains locked to prevent rotation of the seconds hand. An example of a friction drive with slippage for setting the timepiece is seen in U.S. Pat. No. 3,290,875 - Egger, et al, assigned to applicant's assignee, wherein a spring plate or washer provides a friction drive between a pinion member and a wheel member, which together make up a reduction gear for the so-called "third wheel assembly".

Another example of a friction coupling in a wheel and pinion reduction gear is seen in U.S. Pat. No. 4,932,011, also assigned to applicant's assignee, wherein a friction drive/slip coupling is formed between a pinion and wheel by inserting a slotted end of the wheel shaft into a hub on the pinion.

A similar friction coupling between two gear members is also seen in Swiss Patent 5739 issued 10 Oct. 1892 to Lugrin.

One of the problems with friction couplings of the type described is the inability to obtain consistent values of the breakaway torque required to slip the coupling. The systems disclosed in the prior art mentioned above are both expensive to manufacture and do not always give consistent torque readings. Particularly when attempting to reap the benefits of lower cost plastic components, known types of slip couplings employing plastic-to-plastic friction surfaces are quite unreliable.

Accordingly, one object of the present invention is to provide an improved reduction gear assembly for a wheel and pinion with an improved friction drive/slip coupling between the pinion and wheel members.

Another object of the invention is to provide an improved and lower cost reduction gear assembly for the "third wheel" of a timepiece.

Still another object of the invention is to provide an improved reduction gear assembly of a metal pinion and a plastic wheel providing a friction drive with a more reliable consistent range for the torque necessary to provide slippage between the members.

SUMMARY OF THE INVENTION

Briefly stated, the invention comprises an improved reduction gear assembly with friction drive/slip coupling for a timepiece movement, comprising a metal pinion member having a toothed pinion and a coaxial stem extending from an abutment surface on said pinion, said stem including (1) a cylindrical portion, (2) a frustum portion tapering from a smaller diameter to a larger diameter (3) a terminating tapered end portion; and a plastic wheel member having a toothed wheel and first and second coaxial journals extending from opposite sides of said wheel, said journals adapted to rotatably support said wheel and pinion assembly in said time piece movement, said first and second journals together defining a central passage having a constricted section therein with a diameter slightly less than that of said larger diameter of said frustum portion on said metal pinion member, said pinion stem cylindrical portion rotatably disposed in said central passage, with one of said journals abutting said toothed pinion abutment surface and said frustum disposed in said constricted passage with a snap fit, whereby a friction drive/slip coupling is provided between said metal frustum portion of said metal pinion member and said constricted passage of said plastic wheel member.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawing, in which:

DESCRIPTION OF THE PREFERRED EMBODIMENT

Figure 1:
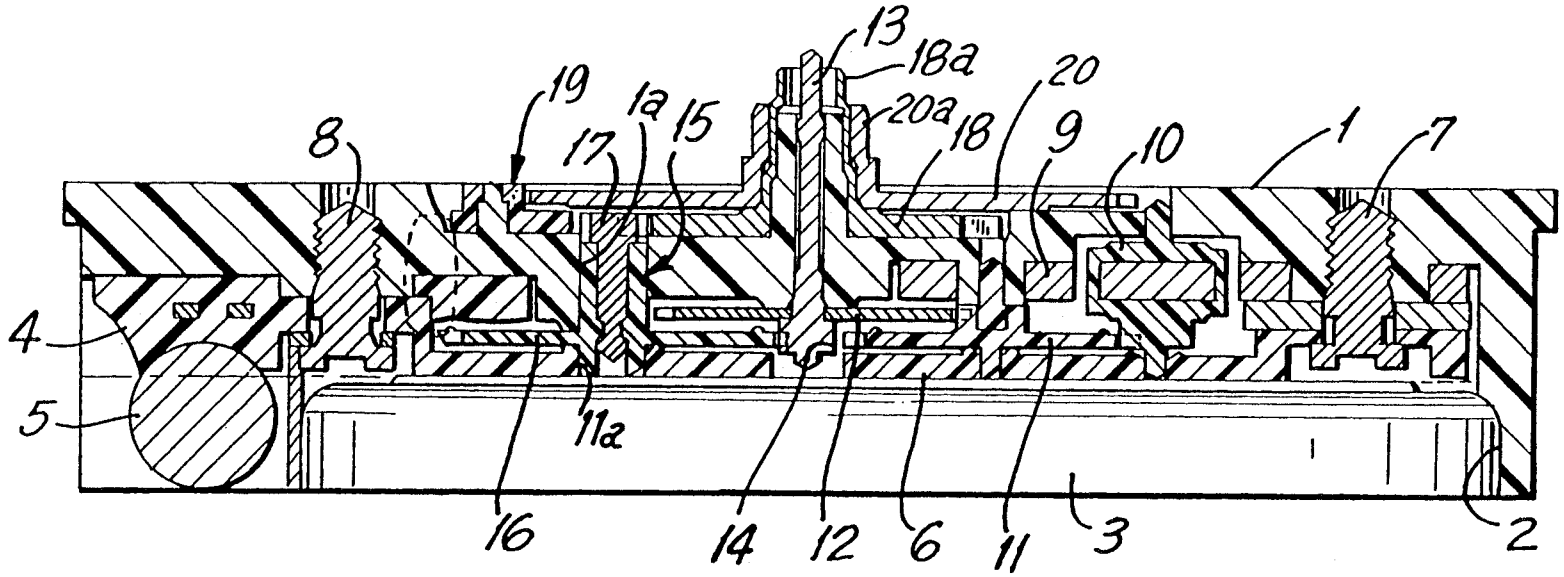
FIG. 1 is a side elevation view, in cross section, of an electronic timepiece movement without the watch case, dial or watch hands.

Referring now to FIG. 1 of the drawing, an electronic timepiece movement is illustrated in cross section as comprising a frame member 1 of plastic omitting the timepiece case, case back, dial, hands and lens which are necessary to make a complete electronic timepiece. Frame 1 defines a cavity 2 in the rear which houses a large diameter, flat energy cell 3 and also a space containing an electronic lead frame 4 and a quartz crystal 5. Energy cell 3 is insulated from the timepiece by a plastic bridge member 6 held in place by screws 7, 8. The plastic bridge 6 and the frame 1 define a series of respective pairs of coaxial bearing holes which rotatably support the members of the gear train.

The gear train of the electronic timepiece movement is powered by a stepping motor having a stator 9 and permanent magnet rotor 10. The stepping motor rotor 10 has a pinion meshing with, and driving, an intermediate wheel reduction gear assembly 11 having spindles journaled in the frame and bridge, respectively. Intermediate wheel assembly 11 drives the second wheel 12 attached to a central spindle 13, to which is attached a seconds hand (not shown). A seconds pinion 14 on spindle 13 also drives the hour and minute hands through a reduction gear train. The seconds pinion 14 meshes with and drives the "third wheel" reduction gear assembly 15, which is the object of the present invention.

The reduction gear assembly 15 comprises a plastic wheel member 16 and a metal pinion member 17. The pinion of pinion member 17 meshes and drives a center wheel 18 with a hub 18*a*, to which is attached a minute hand (not shown). Lastly, another reduction gear assembly 19 which is conventional and which is not fully shown because it is outside of the plane of the cross section of FIG. 1, serves to drive an hour wheel 20 having a hub 20*a*, to which is attached an hour hand (not shown).

As is known to those skilled in the art, a conventional timepiece manual setting mechanism (not shown) is engageable with the gear train by means of a manual crown on the exterior of the timepiece to turn the minute wheel for the purpose of setting the hands. When the minute wheel is turned, it tries to rotate the third wheel reduction gear assembly, through its pinion. However, the wheel member of the third wheel reduction gear assembly is locked by the gear train reaction because of the coupling to the stepping motor rotor. When a pre-selected breakaway torque between the locked wheel 16 and the pinion 17 which is being rotated by the manually operated watch crown is exceeded, pinion 17 slips in wheel 16 to accommodate setting the watch hour and minute hands.

Figure 2:
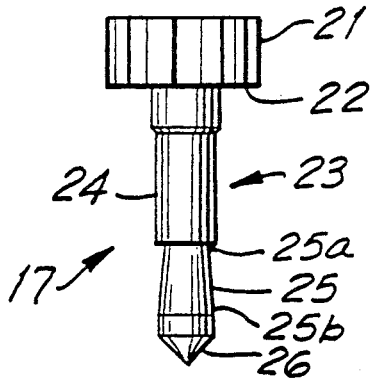
FIG. 2 is an enlarged side elevation view of a metal pinion member.

Turning now to FIG. 2, the enlarged view of metal pinion member 17 shows it to comprise a toothed pinion 21 having a lower abutment surface 22 and an extending stem 23. The stem is machined to include a cylindrical portion 24, connected to a frustum portion 25 for providing a back taper, and terminating in a tapered end portion 26. The smaller end 25*a* of the frustum which is closest to the pinion member 21 has a smaller diameter than that of the cylindrical portion 24 and the frustum diameter gradually increases toward its larger end 25*b*, whose diameter approximates that of the cylindrical portion. A preferred material for the pinion member 17 is nickel silver.

Figure 3:
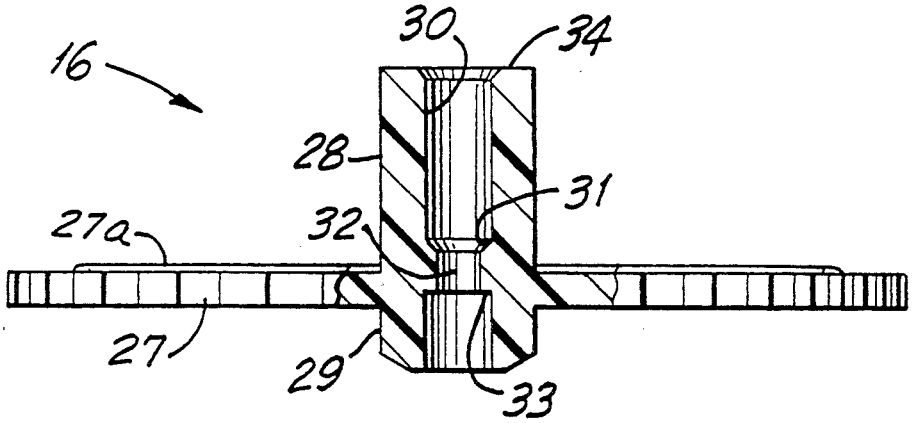
FIG. 3 is an enlarged view, partly in cross section, of a plastic wheel member.

Referring to FIG. 3 of the drawing, the plastic wheel member 16 includes a toothed wheel 27 having formed integrally therewith a first journal 28 and a second journal 29, both coaxial with the center of the wheel. The first journal has a free end 34. The outer surfaces of journals 28, 29 are adapted to rotatably support the assembly in a coaxial pair of holes or bores 1*a*, 11*a* located in frame 1 and 11, respectively (see FIG. 1). Journals 28 and 29 share a central passageway 30. The latter may or may not be open at the end of the lower journal 29. At a pre-selected distance down central passageway 30, commencing at point 31, a constricted passageway 32 is formed, terminating at a sharp circular edge 33. The distance between 31 and 33 is shorter than the axial length of frustum 25. The distance between the top free end 34 of journal 28 and edge 33 is precisely preselected with reference to the distance between abutment surface 22 and the location along the frustrum where it forms an interference fit with edge 33. Edge 33 is preferably located to be coplanar with a plane through the center of toothed wheel 27.

It remains to note that the toothed wheel 27 includes a friction rubbing rim 27*a* which is a raised portion to reduce the friction surface on the face of the toothed wheel. A Preferred material for the toothed wheel is polyacetal plastic .

The reduction gear assembly is assembled by inserting the stem 23 of the metal pinion into the central passage 30 of journal 28. The terminating tapered end of 26 of the pinion is used to guide the stem 23 into the constricted passageway 32. The large end 25 of frustum 25 is forced through the constriction 32 with a snap fit, whereupon the abutment surface 22 of the pinion abuts the free end 34 of journal 28. Passage 30 in journal 28 is adapted to rotatably support the cylindrical portion 24 of the stem. However rotation during normal drive of the gear train is prevented by friction due interference at edge 33.

Figure 4:
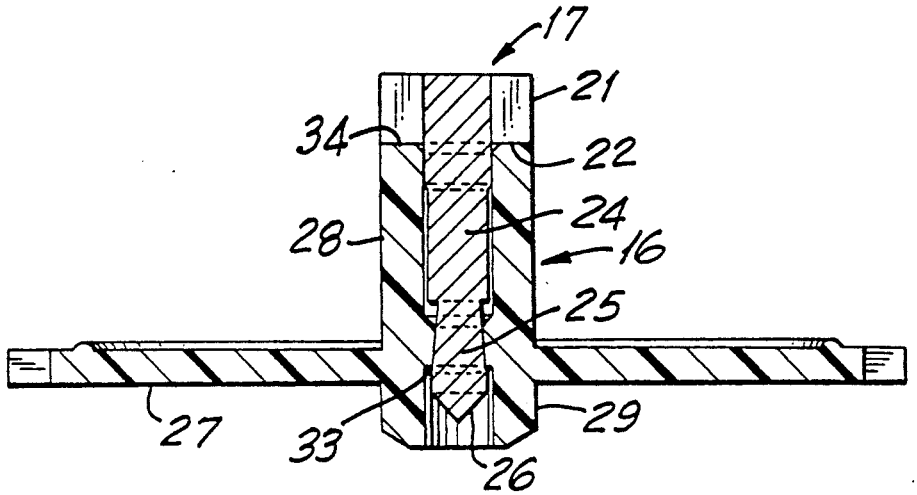
FIG. 4 is an enlarged cross sectional elevation view of a reduction gear assembly comprising the assembled pinion member and wheel member of FIGS. 3 and 4, respectively.

Reference to FIG. 4 illustrates the combined cross-sections of the assembled pinion and wheel members. The precise control of the torque necessary to cause slippage is controlled by the diameter at the edge 33 of the constricted passage, and the diameter of the frustum 25 adjacent edge 33 when the metal pinion 17 is fully snapped into the plastic wheel member 16.

In a preferred arrangement, the diameter of the stem cylindrical portion is 0.27 mm, the diameter of the small end of the frustum is 0.192 mm, the diameter of the large end and of the frustum is 0.250 mm, whereas on the plastic member the inner diameter of passageway 30 is 0.300 mm. The diameter of the constricted passage is 0.226 mm at edge 33, while the diameter of the frustrum adjacent edge 33 is 0.252 mm, giving an interference of 0.026 mm.

Through the arrangement described above, slippage is achieved when one member is locked and a breakaway torque of between 4 and 10 gram-millimeter is exerted on the other member.

While there has been disclosed what is considered to be the preferred embodiment of the invention, other modifications will occur to those skilled in the art, and it is desired to secure in the appended claims all such modifications as fall within the true spirit and scope of the invention.

We claim:

1. An improved reduction gear assembly with friction drive/slip coupling for a timpiece movement, comprising:

a metal pinion member having a toothed pinion and a coaxial stem extending from an abutment surface on said pinion, said stem including (1) a cylindrical portion, (2) a frustum portion tapering from a smaller diameter less than that of said cylindrical portion to a larger diameter, and (3) a terminating tapered end portion; and .

a plastic wheel member having a toothed wheel and first and second coaxial journals extending from opposite sides of said wheel, said journals adapted to rotatably support said wheel and pinion assembly, said first and second journals together defining a central passage having a constricted section therein with a diameter slightly less than that of said larger diameter of said frustum portion on said metal pinion member, said pinion stem cylindrical portion rotatably disposed in said central passage with one of said journals abutting said toothed pinion abutment surface and said frustum disposed in said constricted passage with a snap fit, whereby a friction drive/slip coupling is provided between said metal frustum portion of said metal pinion member and said constricted passage of said plastic wheel member.

2. The improvement according to claim 1, wherein said metal pinion member is machined from nickel silver.

3. The improvement according to claim 1, wherein said plastic wheel member is molded of polyacetal plastic.

4. The improvement according to claim 1, wherein said constricted passage terminates at a circular edge which is coplanar with a plane through the center of said toothed wheel, whereby said frustum engages said wheel member with a friction fit near the center of said toothed wheel when the end of said pinion engages said abutment surface.

* * * * *